US011737617B2

(12) United States Patent
Hamza

(10) Patent No.: US 11,737,617 B2
(45) Date of Patent: Aug. 29, 2023

(54) TOWEL DISPENSER

(71) Applicant: Juliana Hamza, Modesto, CA (US)

(72) Inventor: Juliana Hamza, Modesto, CA (US)

( * ) Notice: Subject to any disclaimer, the term of this patent is extended or adjusted under 35 U.S.C. 154(b) by 37 days.

(21) Appl. No.: 17/225,117

(22) Filed: Apr. 8, 2021

(65) Prior Publication Data

US 2022/0322893 A1 Oct. 13, 2022

(51) Int. Cl.
*A47K 10/38* (2006.01)

(52) U.S. Cl.
CPC ..... *A47K 10/3836* (2013.01)

(58) Field of Classification Search
USPC ..... 242/593
See application file for complete search history.

(56) References Cited

U.S. PATENT DOCUMENTS 2,307,994 A * 1/1943 Clemens ..... A47K 10/38 242/560.3
2,872,125 A * 2/1959 Rial ..... A47K 10/3836 242/597.7
4,951,837 A 8/1990 Lentsch
5,219,092 A * 6/1993 Morand ..... A47K 10/424 221/48
5,263,607 A * 11/1993 Temesvary ..... A47K 10/3818 225/106
5,765,718 A 6/1998 Grasso et al.
5,868,346 A * 2/1999 Cobos ..... A47K 10/3818 242/593
5,950,863 A * 9/1999 Schutz ..... A47K 10/424 221/48
6,053,355 A * 4/2000 Rupp ..... A47K 10/38 221/45
6,129,240 A 10/2000 Morand
6,779,683 B2 * 8/2004 Taylor ..... A47K 10/424 221/48
6,899,251 B2 5/2005 Christensen et al.
7,398,944 B2 7/2008 Lewis et al.
9,988,190 B2 6/2018 Berg et al.
10,231,580 B2 * 3/2019 Rozek ..... A47K 10/3818
2008/0001017 A1 * 1/2008 Saarvali ..... A47K 10/3818 242/593

OTHER PUBLICATIONS

Phelps cloth roll dispenser, accessed on Dec. 8, 2020 at the following URL https://phelpsusa.com/product/cloth-roll-towel-dispenser.

* cited by examiner

*Primary Examiner* — William A. Rivera
(74) *Attorney, Agent, or Firm* — Sierra IP Law, PC; William K. Nelson

(57) ABSTRACT

The present invention relates to an improved towel dispenser. Embodiments of the present invention provide an improved towel dispenser comprised of a towel receptacle, a receptacle lid, and an adjustable wall mounting mechanism. The towel receptacle comprises a superior and inferior opening and is shaped in a manner that inclines towels stored therein towards the inferior opening. The receptacle lid is mounted such that towels are sealed within the towel receptacle during normal use. The adjustable wall mounting mechanism is utilized to mount the towel receptacle and the receptacle lid in a manner that enables the towel receptacle to be repositioned on a vertical track with ease. This repositioning enables the improved towel dispenser to be reloaded with ease.

16 Claims, 11 Drawing Sheets

TOWEL DISPENSER

FIELD OF THE INVENTION

The present invention relates to a novel towel dispensing device. More particularly, embodiments of the present invention pertain to an improved towel dispenser for dispensing cloth towels without the need to first arrange them in a particular matter.

DISCUSSION OF THE BACKGROUND

Towels are a valuable commodity found in almost every household and business. While there are a large variety of towel dispensers currently on the market that enable ease of distribution and use of a towel product, they all come with their fair share of limitations. Most towel dispensers are limited to a certain material organized in a pre-determined arrangement (e.g., folding, stacking, etc.) to enable a dispenser to properly dispense towels. For example, the vast majority of towel dispensers are limited to relatively small, thin, and disposable paper sheets that must be rolled or folded in a particular manner to enable proper dispensing. Such dispensers are incompatible with reusable cloth towels due to the impracticality of folding or rolling the towels for dispensing.

Salons, barbers, and several hygiene service businesses use a great deal of textile towels every day, having to use a new towel for each customer. These business waste significant manhours folding and storing textile towels for use with customers. Thus, there remains a need for an improved towel dispenser that enables ease of use and distribution of cloth towels.

SUMMARY OF THE INVENTION

The present invention relates to an improved towel dispenser for use with textile towels (e.g., cloth, terrycloth, etc.). Embodiments of the present invention provide an improved towel dispenser comprised of a towel receptacle, a receptacle lid, and an adjustable wall mounting mechanism. The towel receptacle comprises a superior and inferior opening and is shaped in a tapered manner that inclines towels stored therein towards the inferior opening. The receptacle lid is mounted such that the receptacle can be sealed against the lid, and hold clean towels within the towel receptacle during normal use without contamination with hair, dust, or other potential contaminants in the ambient air. The adjustable wall mounting mechanism is utilized to mount the towel receptacle and the receptacle lid in a manner that enables the towel receptacle to be repositioned on a vertical track. This repositioning enables the improved towel dispenser, hereinafter referred to as the dispenser, to be reloaded easily.

The present invention may have two primary orientations, a reloading orientation, and a dispensing orientation. The dispensing orientation is the orientation the dispenser is in during normal usage, wherein a towel may be easily grasped by or dispensed to a user. The dispenser may be set to the dispensing orientation by using the adjustable mounting mechanism to reposition the towel receptacle to the uppermost point on the vertical track. This orientation enables the receptacle lid to properly seal the superior opening of the towel receptacle and prevent any contamination and debris in the ambient air from entering the towel receptacle. The dispenser may be set to a reloading orientation by utilizing the adjustable mounting mechanism to reposition the towel receptacle at or near the lowermost point on the vertical track. This orientation enables a human operator to reload the towel receptacle with ease by providing easy access to the large superior opening of the towel receptacle to the operator.

In the present invention, the towel receptacle may be comprised of plastic, metal, wood, or any material rigid enough to hold several textile towels within the towel receptacle without deformation. A maximum load of towels may be the maximum volume of towels that the towel dispenser can hold when the receptacle is raised to meet the lid. For example, the maximum load may be, e.g., 40 hand towels having a width of 12 inches and a height of 24 inches or about 5 pounds to about 30 pounds of textile towel mass.

In the present invention, the towel receptacle comprises a shape that causes the towels stored therein to be inclined towards the inferior opening of the towel receptacle, enabling the distribution of cloth towels with ease. The towel receptacle shape may be a protruding and tapering portion that may be a portion of a polyhedron, ellipsoid, cylinder, conical, or a mixture thereof. The shape of the towel receptacle may comprise a flat side or edge utilized to attach the towel receptacle to the adjustable mounting mechanism. In some embodiments, the shape of the towel receptacle may be to resemble half a funnel with a flat side (i.e., semi-conical) that's utilized to install the adjustable mounting mechanism. In such embodiments, the towel receptacle may have a superior opening with a radius in a range of about 8 inches to about 24 inches (e.g., about 11 inches, about 15 inches, about 20 inches, or any value therein) that narrows linearly to a radius of about 2 inches to about 6 inches (e.g., about 3.5 inches, about 5 inches, or any value therein) at the inferior opening. In some embodiments, the superior opening may have a width in the range of about 16 inches to about 48 inches (e.g., about 22 inches, about 30 inches, about 40 inches, or any value therein) and a depth in the range of about 6 inches to about 30 inches. In some embodiments, the inferior opening may have a width in the range of about 4 inches to about 12 inches (e.g., about 6 inches, about 10 inches, or any value therein) and a depth in the range of about 2 inches to about 8 inches. In some embodiments, the dispenser may have a height of about 18 inches to about 50 inches wherein the height is determined by the distance between the inferior opening and superior opening. For example, the conical-shaped towel receptacle may have a height of about 30 inches with a superior opening with a radius of about 12 inches that narrows linearly to a radius of about 4.5 inches at the inferior opening. In some embodiments, the towel receptacle may have a lower section and an upper section, with the lower section having a tapered shape (e.g., having a conical shape) and an upper section with a more uniform width (e.g., a cylindrical shape).

In the present invention, the towel receptacle comprises a superior opening for reloading, and an inferior opening for dispensing. Both the superior and inferior openings may be shaped to have polygonal, ellipsis, semi-ellipsis, semi-circular, or other appropriate shapes. The size and shape of each opening may be determined by one or more dimensions. The dimension(s) may depend on the desired shape of the upper or lower opening for a particular towel receptacle, and may include the length of a side, chord, radius, arc, or even one or more angle in the shape. For example, for a towel receptacle with a semi-conical structure, both openings may have a semicircular or semi-ellipsis shape wherein the dimension that dictates the size of the opening may be the radius of the circle. For example, for a towel receptacle with an inverted pyramid structure, both openings may have a triangular shape wherein the dimensions that dictate the size of the opening may be a side and angle of the triangles.

In the present invention, the magnitude of the dimension that determines the size of each opening may be determined by the size of the towel receptacle and/or the size of the towel being dispensed therefrom. The dimension of the superior opening may be proportional to the size of the towel receptacle. For example, for a towel receptacle with a semi-conical structure, the superior opening may be a semicircle with a radius (i.e., the dimension) of approximately 12 inches for a receptacle height of about 30 inches and about 18 inches for a towel receptacle height of about 45 inches (e.g., a ratio of 2:5). The magnitude of the dimension of the inferior opening may depend on the properties of the towels. Hand towels are typically 15 by 25 inches or 18 by 30 inches, and for a towel receptacle with a semi-conical structure having a height of approximately 30 inches, the inferior opening may be a semicircle with a radius (i.e., the dimension) of at least 3 inches to allow the towels to be easily removed therefrom without allowing the towels to fall through the hole without being pulled by a human operator. The magnitude of the dimension may also depend on the desired width and/or depth of the respective opening. For example, if the desired width of a superior opening is 24 inches for a towel receptacle with a semi-conical structure, the magnitude of the radius (i.e., the dimension) may be determined to be 12 inches.

The inferior opening of the towel receptacle may further comprise a grommet, operable to aid in preventing towels from falling out of the dispenser. The grommet may be comprised of a pliable material, such as plastic, rubber, or other polymeric material. The grommet may include multiple flaps and a central opening to allow the human operator to reach into and grasp a towel near the inferior opening. In other embodiments, the inferior opening may have a gasket with a central opening having a diameter of at least two inches.

In the present invention, the receptacle lid has a shape and size complimentary to the superior opening of the towel receptacle and is intended to seal the towels within the towel receptacle and prevent atmospheric particles or debris from entering the towel receptacle during normal use. In some embodiments, the receptacle lid is fixed at the upper end of the vertical track of the adjustable wall mounting mechanism. The lid may allow the towel receptacle to be sealed only during normal usage. This enables the superior opening of the towel receptacle to be exposed for a reloading process when the towel receptacle is repositioned further below via the adjustable wall mounting mechanism.

The present invention comprises an adjustable wall mounting mechanism that is utilized to mount the receptacle lid and towel receptacle. The adjustable mounting mechanism may be comprised of two parts, a fixed mount, and an adjustable mount. The fixed mount is operable to fix the receptacle lid in place such that, during normal usage, the superior opening is sealed by the receptacle lid such that hair, dust, and other debris may not enter the towel receptacle. The fixed mount may be based on brackets, screws/nails, adhesives, or any mounting mechanism operable to firmly affix the receptacle lid in place. The adjustable mount is operable not only to mount the towel receptacle onto a flat surface, but to adjust the position of the towel receptacle on a vertical track. The adjustable mount may be based on drawer slides, rollers/carriages (e.g., ball bearing carriages, sleeve bearing carriages, track roller carriages, roller bearing carriages, track rollers, etc.) with guide rails, linear motion shaft, positioning slides, or any mounting mechanism that may reposition the towel receptacle on a vertical track. For example, the adjustable mount may be a traveler on a track having a ball-bearing mechanism to reduce friction. The track may be vertical and may support the towel receptacle and the corresponding load. The ball bearing mechanism may be operable to enable the traveler to move freely and easily along the track. In some embodiments, the adjustable mount may further comprise a motor operable to automatically reposition the towel receptacle at the press of a button. For example, the adjustable mount may be powered by an electric motor belt drive mechanism that may reposition the dispenser between a reloading orientation and dispensing orientation once a toggle switch is pressed.

The adjustable mount may further comprise a locking mechanism, operable to lock the towel receptacle in place at one or more points on the vertical track. The points may be the uppermost and/or the lower most points on the vertical track, such that the towel receptacle may be locked to either the dispensing orientation or reloading orientation. In some embodiments, the receptacle may be locked into position at any point along the vertical track. In some embodiments, the locking mechanism may be integrated into the adjustable mount, wherein the locking may be controlled manually such as with a hand brake, switch, or by applying force to the adjustable mount in a particular manner (i.e., push-to-open). For example, an adjustable mount may comprise a ball bearing carriage and guide rails system with a hand brake, wherein the ball bearing carriage may support the towel receptacle and lock it in place via the hand brake anywhere on the guide rails. In other embodiments, the locking mechanism may be an entirely separate component from the adjustable mount, such as a simple tab operable to lock the towel receptacle and the adjustable mount and hold it at a point.

In some embodiments, the dispenser may alternatively be mounted on a mobile base (e.g., a cart or moveable stand) that allows the dispenser to be moved from station to station in an environment (e.g., from chair to chair in a salon). In such embodiments, certain features of the dispenser may be altered. For example, the shape of the dispenser may be a complete cone, e.g., mounted on a ring on the stand or cart into which the dispenser is placed. In other embodiments, the semi-circular conical dispenser may be mounted on a flat vertical surface on the cart or moveable stand. In such embodiments, the lid may have a different configuration. For example, the lid may be a hinged, pivoting lid, a pressure-fitting lid, or other design in mobile embodiments.

In some embodiments, a window may be present in the wall of the receptacle to allow the amount of towels in the dispenser to be observed. The window may have a width sufficient to see the general level of the towels in the dispenser. The window may be made of a transparent polymer or glass sheet embedded or attached to the sidewall of the receptacle.

The shape of the present invention, along with its ability to be easily repositioned into a reloading orientation, vastly reduces the amount of effort and time an operator must expend in organizing towels for use. Clean towels can simply be dumped into the receptacle through the superior opening of the receptacle when the receptacle is lowered on the vertical track away from the lid. The shape of the towel receptacle enables the dispenser to utilize gravitational force to incline the towels therein towards the inferior opening, enabling any textile towel to be easily dispensed/grasped from the inferior opening of the towel receptacle, regardless of the orientation of the towel. In other words, the shape of the towel receptacle enables the dispenser to be easily loaded with towels without the need to fold, roll or arrange the towels in any particular manner. The towel receptacle's ability to be repositioned further simplifies the process by making the superior opening of the towel receptacle more accessible. For example, while conventional methods would require an operator to fold each individual towel and place them in an area safe from atmospheric particles/debris (e.g., water, hair, dust, etc.), the present invention may enable the operator to simply reposition the towel receptacle into a reloading orientation, dump all towels into the towel receptacle, and reposition the towel receptacle.

In one aspect the present invention is an improved towel dispenser for distributing cloth towels with ease comprising: a towel receptacle having a superior opening, an inferior opening, and a portion with a tapering shape; a receptacle lid to seal the superior opening during normal use, and an adjustable wall mounting mechanism operable to mount the towel receptacle lid and reposition the towel receptacle between a reloading orientation and a dispensing orientation. The towel receptacle may have a tapering shape that inclines towels towards the inferior opening and may contain a flat side that enables the towel receptacle to be mounted on a flat surface via the adjustable wall mounting mechanism. The dispenser may have a semi-conical shape. The inferior and superior openings of the towel receptacle may each have a shape that is polygonal, ellipsis, semi-ellipses, semicircular, or a mixture thereof wherein the size of each opening may have one or more dimensions. The superior opening may have a size that allows towels to be easily dumped into the opening from a basket or other receptacle, and may have a width in a range of about 16 inches to about 40 inches and a depth in a range of about 6 inches to about 30 inches. The magnitude of the dimension of the inferior opening may depend on the properties of the towel, such that the inferior opening has a size that is sufficient to allow towels to be pulled through the opening without the towels falling through the opening without being pulled by a human operator. The inferior opening may have a width of about two inches to about 6 inches and a depth in the range of about 2 inches to 6 inches.

The properties that control the passage of the towels through the dispenser may be size, texture, and/or material of the towels and the shape and size of the towel receptacle. The magnitude of the dimension of the inferior opening may also depend on the size and shape of the towel receptacle. The towel receptacle may have a semi-conical shape with a height in a range of about 18 inches to about 50 inches, a superior opening having a semi-circle shape with a radius (i.e., the dimension) of approximately 12 inches, and an inferior opening having a semicircular shape with a radius of approximately 4.5 inches. The inferior opening may further comprise a rubber grommet or gasket operable to prevent the towels from falling from the inferior opening. The adjustable wall mounting mechanism may be comprised of a fixed mount and an adjustable mount. The fixed mount may be operable to fix the receptacle lid in place and may include brackets, screws/nails, adhesives, or any mounting mechanism operable to firmly affix the receptacle lid in place. The adjustable mount may be operable to mount the towel receptacle on a flat surface and reposition it on a vertical track. The towel receptacle may be in a reloading orientation when the towel receptacle is at or near the lowermost point on the vertical track. The towel receptacle may be in the dispensing orientation when the towel receptacle is at the uppermost point on the vertical track. The adjustable mount may be rollers/carriages with guide rails, linear motion shafts, or positioning slides. The adjustable mount may further comprise a locking mechanism, operable to lock the towel receptacle at one or more points on the vertical track, wherein at least one of the points may be the uppermost point on the track. The adjustable mount may be based on rollers/carriages with guide rails, wherein the guide rails provide the vertical track.

It is an object of the present invention to provide an improved towel dispenser operable of dispensing and being reloaded with ease.

It is also an object of the present invention to provide an improved towel dispenser operable of dispensing cloth towels without the need to arrange them in any particular manner in advance.

It is also an object of the present invention to provide an improved towel dispenser having a reloading orientation to be reloaded quickly and easily by an operator.

It is also an object of the present invention to provide an improved towel dispenser having a towel receptacle shape that inclines towels towards an inferior opening for towel disbursement.

It is also an object of the present invention to provide an improved towel dispenser having a dispensing orientation enabling a user to easily grasp/receive a towel.

DETAILED DESCRIPTION

Figure 1A:
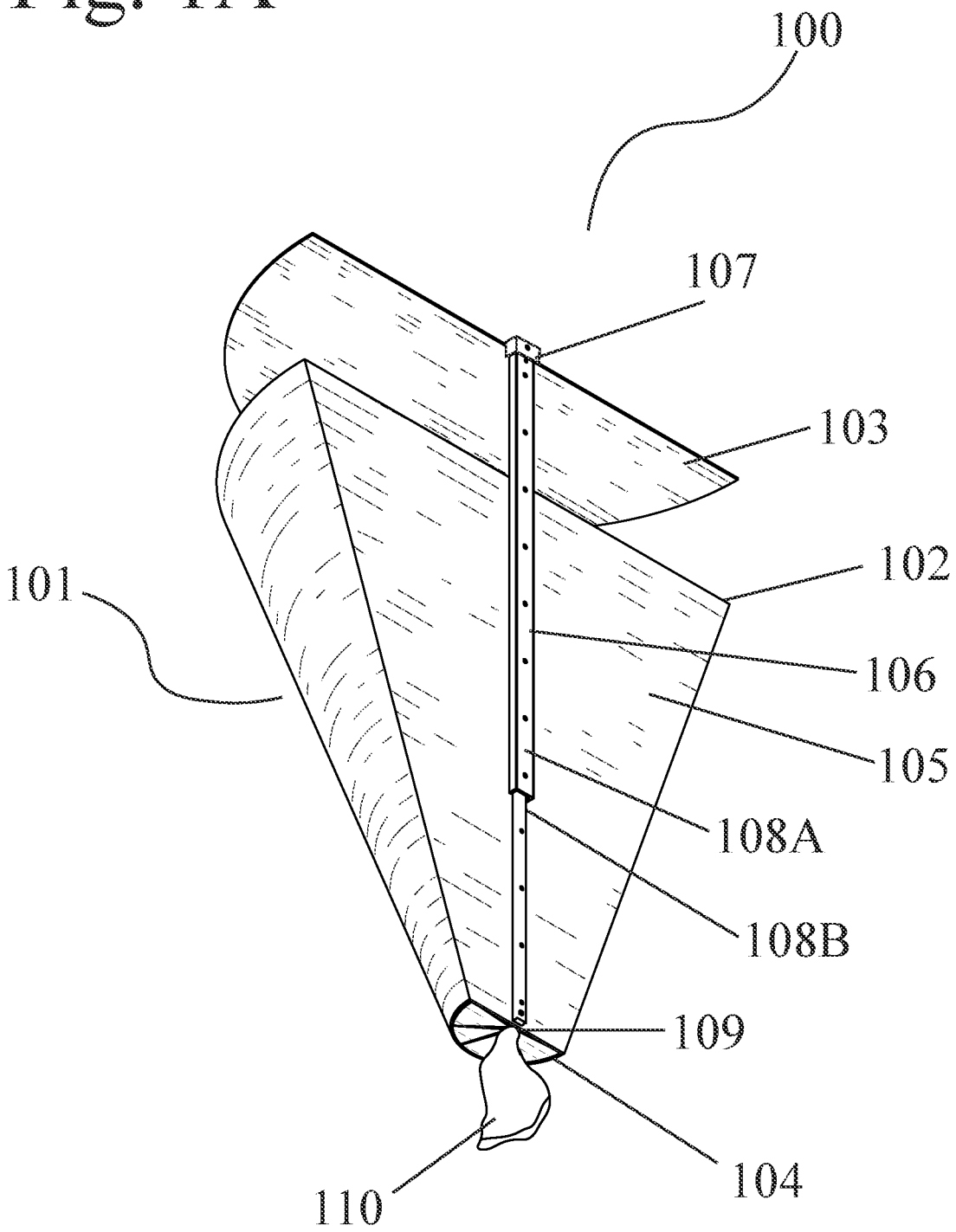
FIG. 1A shows a rear perspective view of an improved towel dispenser device, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

As shown in FIGS. 1A-7B, embodiments of the present invention provide an improved towel dispenser 100 comprised of a towel receptacle 101, a receptacle lid 103, and an adjustable wall mounting mechanism 106. The towel receptacle 101 comprises a superior opening 102, an inferior opening 104, and a shape that inclines towels stored therein towards the inferior opening 104. The receptacle lid 103 is mounted such that towels are sealed within the towel receptacle 101 during normal use. The adjustable wall mounting 106 mechanism is utilized to mount the towel receptacle and the receptacle lid in a manner that enables the towel receptacle 101 to be repositioned on a vertical track with ease. This repositioning enables the improved towel dispenser 101, to allow the dispenser to be reloaded with fresh towels. The embodiment of FIG. 1C includes window 150 to allow the amount of towels in the receptacle 101 to be viewed from the exterior thereof.

Figure 8:
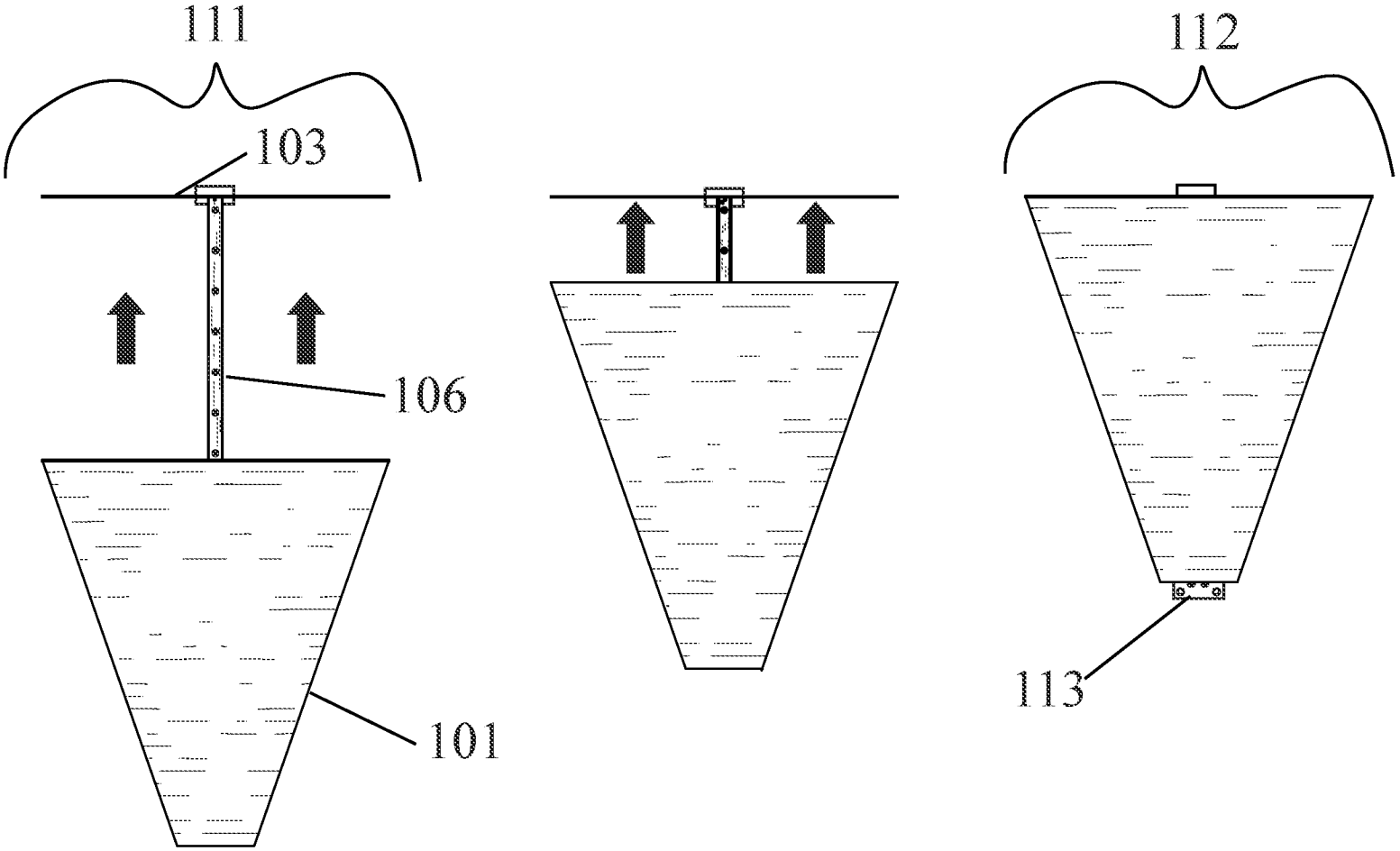
FIG. 8 shows the transition from a reloading orientation to a dispensing orientation, according to an embodiment of the present invention.

As shown in FIG. 8, present invention may have two primary orientations, a reloading orientation 111, and a dispensing orientation 112. The dispensing orientation 112 is the orientation the dispenser is in during normal usage, wherein a towel may be easily grasped by or dispensed to a user. The dispenser 100 may be set to the dispensing orientation by using the adjustable mounting mechanism 106 to reposition the towel receptacle 101 to the uppermost point on the vertical track. This orientation enables the receptacle lid 103 to properly seal the superior opening of the towel receptacle 101 and prevent any atmospheric particles/debris from entering the towel receptacle 101. The reloading orientation 112 is the orientation the dispenser 100 is in during a reloading process. The dispenser may be set to the reloading orientation 111 by utilizing the adjustable mounting mechanism 106 to reposition the towel receptacle 101 to the lowermost point on the vertical track. This orientation enables an operator to reload the towel receptacle 101 with ease by increasing the operator's accessibility of the superior opening 102 of the towel receptacle.

In the present invention, the towel receptacle 101 may be comprised of plastic, metal, wood, or any material rigid enough to allow substantial compression of the towels within the towel receptacle without causing the towel receptacle to break or expand. Substantial compression here may be defined here as the amount of compression within the towel receptacle when the towel receptacle is carrying a maximum load of towels. The maximum load of towels may be the maximum volume of towels that the towel receptacle is operable to hold. For example, the maximum load may be in a range of about 20 to about 40 hand towels having a width of about 12 inches and a height of 24 inches. In order to minimize user error, the maximum weight that the system can hold may be significantly more (e.g., about 10% to 30%) than the weight of a maximum load of towels the towel receptacle is operable to hold.

Figure 1B:
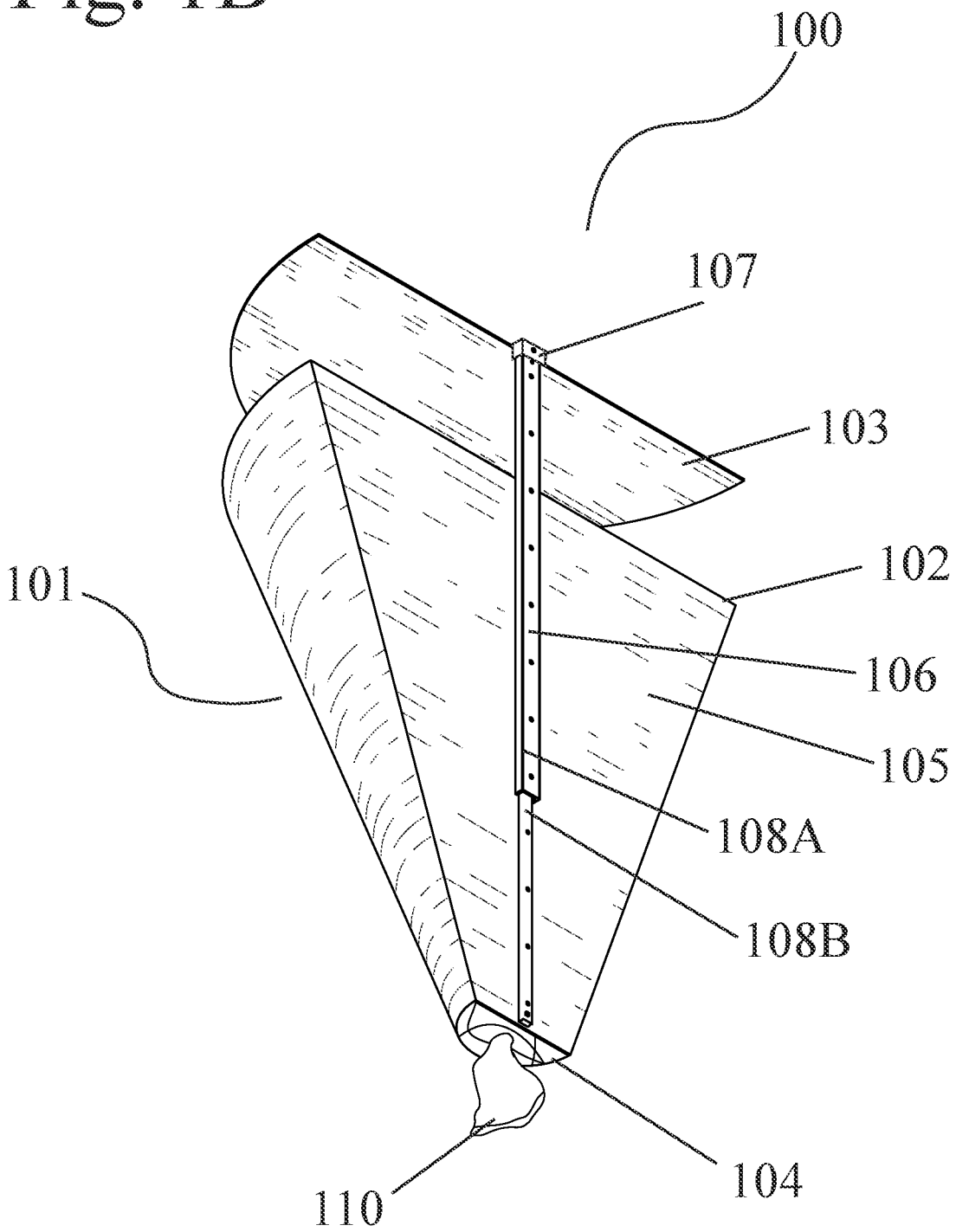
FIG. 1B shows a rear perspective view of an improved towel dispenser device, according to an embodiment of the present invention.
Figure 1C:
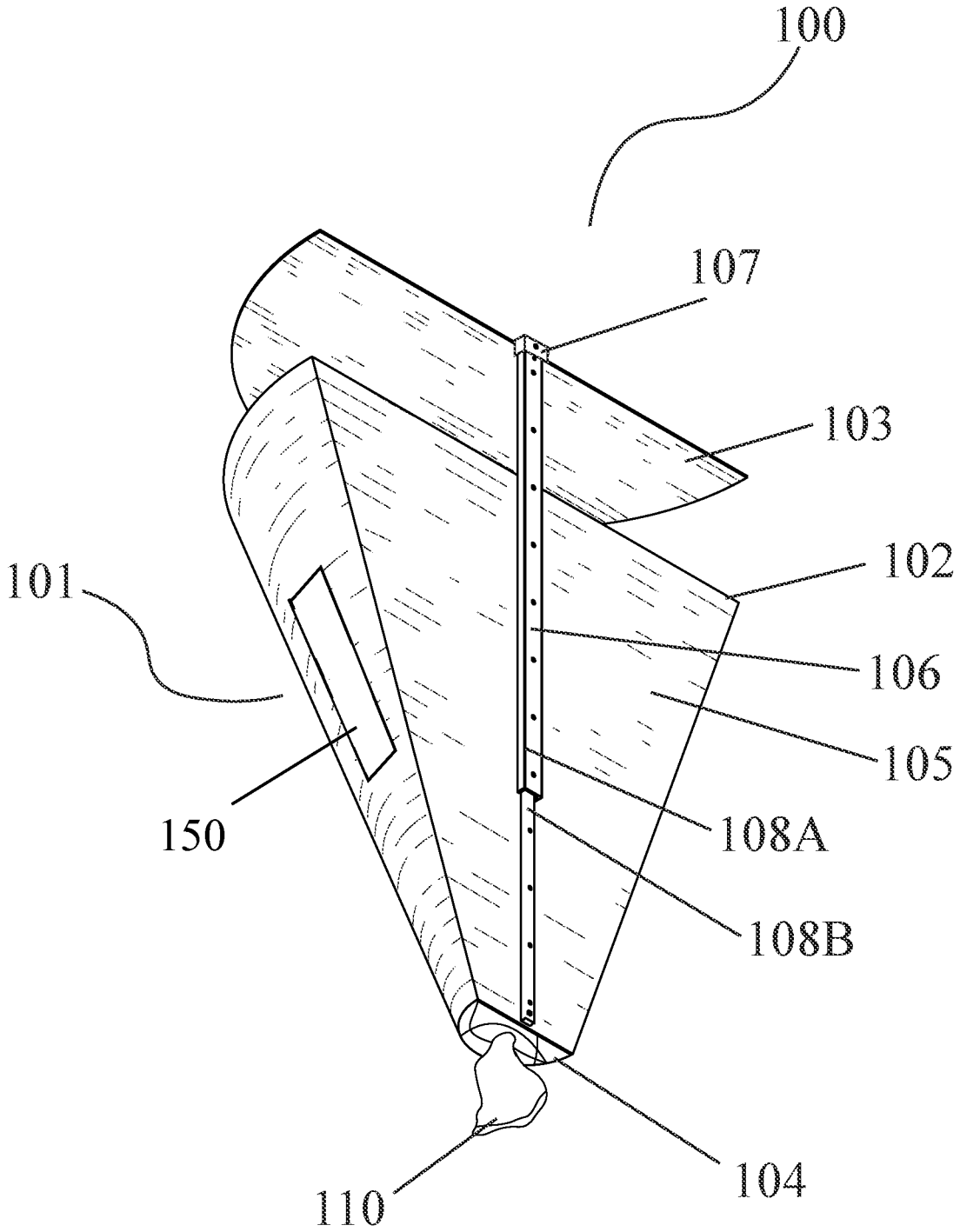
FIG. 1C shows a rear perspective view of an improved towel dispenser device, according to an embodiment of the present invention.
Figure 2:
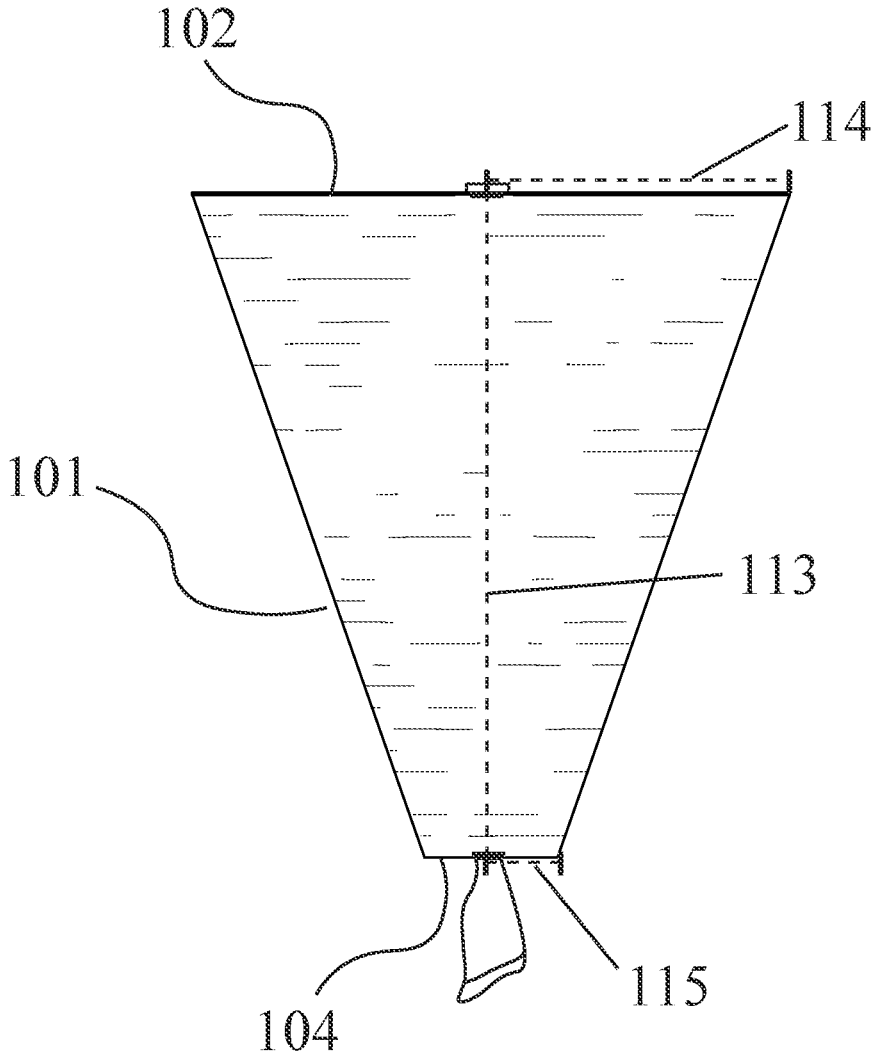
FIG. 2 shows a perspective view of an improved towel dispenser device, according to an embodiment of the present invention.
Figure 3:
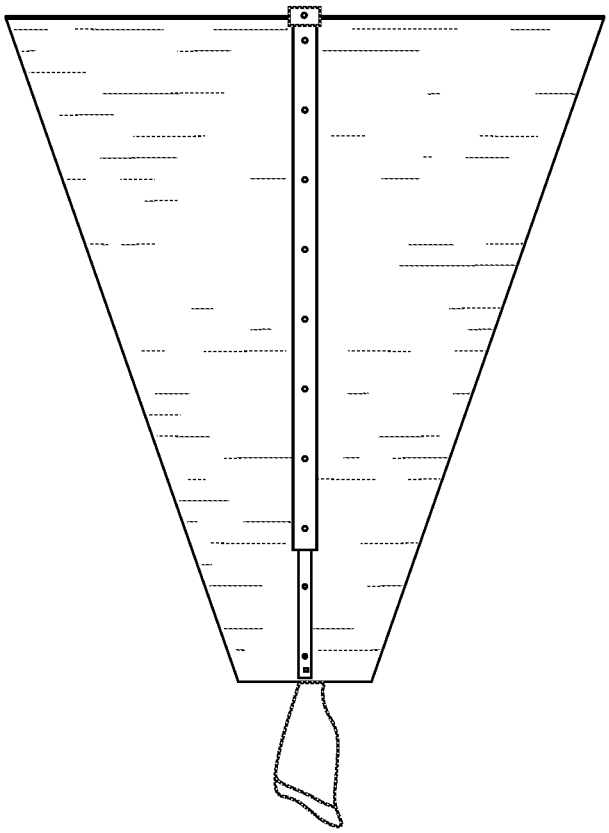
FIG. 3 shows a rear view of an improved towel dispenser device, according to an embodiment of the present invention.
Figure 4:
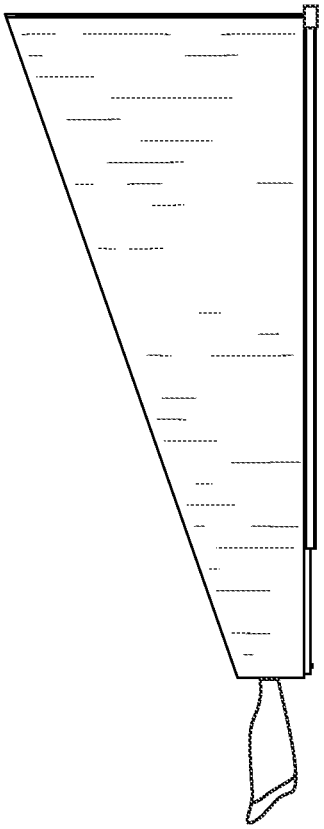
FIG. 4 shows a first side view of an improved towel dispenser device, according to an embodiment of the present invention.
Figure 5:
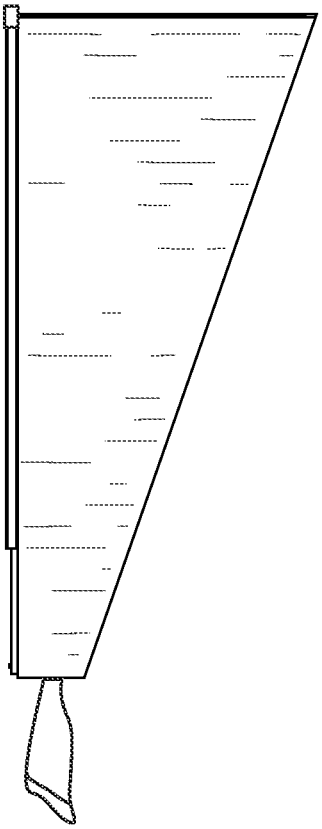
FIG. 5 shows a second side view of an improved towel dispenser device, according to an embodiment of the present invention.
Figure 6:
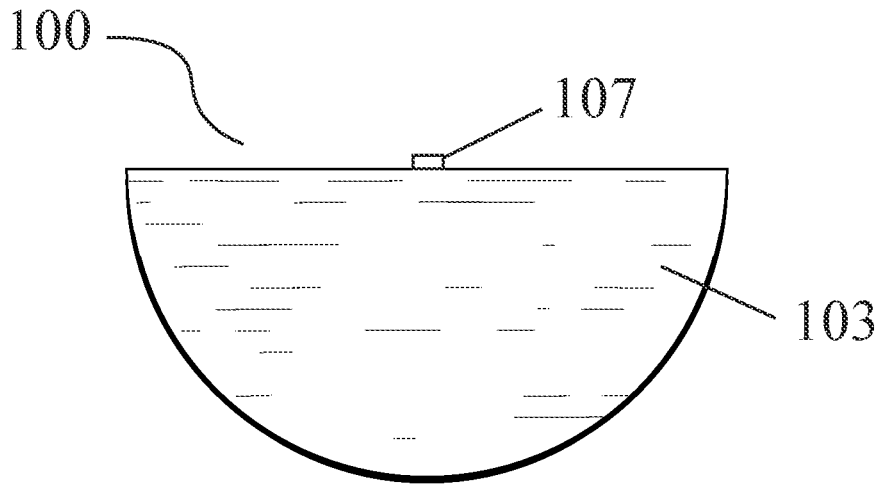
FIG. 6 shows a top view of an improved towel dispenser device, according to an embodiment of the present invention.
Figure 7A:
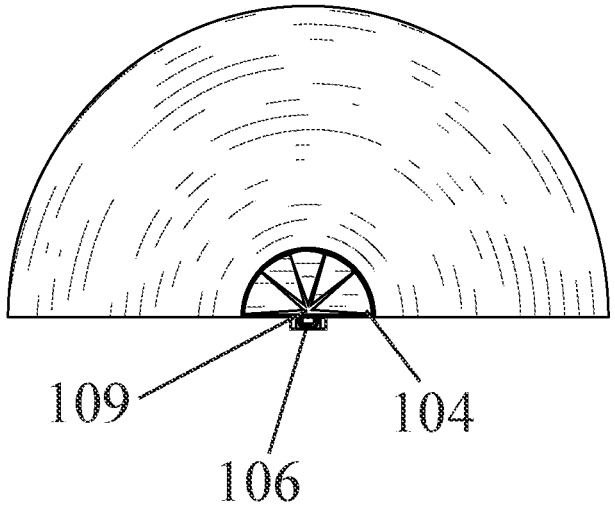
FIG. 7A shows a bottom view of an improved towel dispenser device, according to an embodiment of the present invention.
Figure 7B:
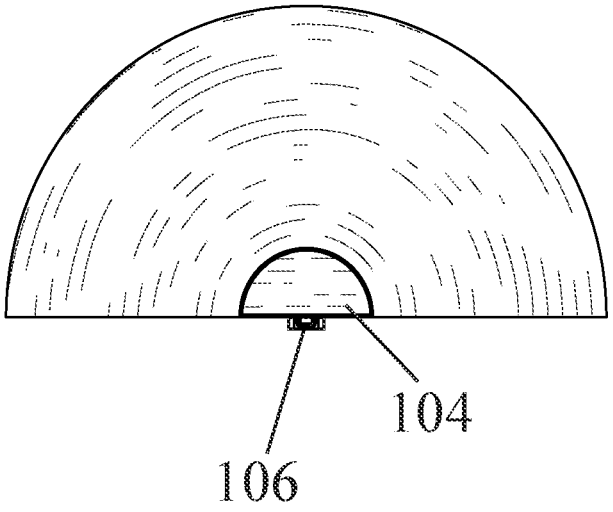
FIG. 7B shows a bottom view of an improved towel dispenser device, according to an embodiment of the present invention.

As shown in FIG. 1, the towel receptacle 101 comprises a shape that causes the towels stored therein to be inclined towards the inferior opening 104 of the towel receptacle, enabling the distribution of cloth towels from the inferior opening. While the towel receptacle 101 is shown to have a semi-funnel shape, the shape may be a polyhedron, ellipsoid, cylinder, a cone, or a mixture thereof. The shape of the towel receptacle 101 may comprise a flat side 105 or edge utilized to attach the towel receptacle 101 to the adjustable mounting mechanism 106 adjacent to a wall. In some embodiments, the shape of the towel receptacle 101 may be to resemble half a funnel (i.e., semi-conical) with a flat side 105 that's utilized to install the adjustable mounting mechanism 106. As shown in FIG. 2, in such embodiments, the towel receptacle 101 may have a superior opening 102 with a radius 114 in a range of about 8 inches to about 24 inches (e.g., about 11 inches, about 15 inches or any value therein) that narrows linearly to a radius 115 of about 2 inches to about 6 inches (e.g., about 4 inches, or any value therein) at the inferior opening 104. In some embodiments, the superior opening 102 may have a width in the range of about 16 inches to about 48 inches (e.g., about 22 inches, about 30 inches, about 40 inches, or any value therein) and a depth in the range of about 6 inches to about 30 inches. In some embodiments, the inferior opening 104 may have a width in the range of about 4 inches to about 12 inches (e.g., about 6 inches, about 10 inches, or any value therein) and a depth in the range of about 2 inches to about 6 inches. In some embodiments, the dispenser 100 may have a height of about 18 inches to about 50 inches wherein the height is determined by the distance 113 between the inferior opening 104 and superior opening 102. For example, the conical-shaped towel receptacle 101 may have a height of about 30 inches with a superior opening 102 with a radius 114, e.g., of about 12 inches that narrows linearly to a radius 115, e.g., of about 3.5 inches at the inferior opening 104. In some embodiments, the volume of the towel receptacle 101 may be expanded by adding an extension (e.g., a semi-cylinder portion to the upper end of the towel receptacle 101). This increase in volume within the towel receptacle 101 allows for more towel capacity.

In the present invention, the towel receptacle 101 comprises a superior opening 102 for reloading, and an inferior opening 104 for dispensing. Both the superior and inferior openings may be shaped to have polygonal, ellipsis, semi-ellipsis or a mixture thereof, wherein the size of each opening may be construed from one or more dimensions. The dimension(s) may depend on the desired shape of the opening(s) for a particular towel receptacle and may include the length of a side, chord, radius, arc, or even one or more angle in the shape. For example, as shown in FIG. 2, a towel receptacle with a semi-conical structure, both openings (102 and 104) may have a semicircular or semi-ellipsis shape wherein the dimension that dictates the size of the opening may be the radius (114 and 115) of the circle.

As shown in FIG. 1, the inferior opening of the towel receptacle may include a grommet 109 to aid in retaining the towels in the dispenser. The grommet 109 may be comprised of polymeric material, such as rubber, silicone, PTFE, or other such materials. The grommet 109 may provide an opening having a radius of about 2 inches to about 6 inches (e.g., about 3 inches, about 3.5 inches, or any value therein). In some embodiments, the inferior opening 104 may be the grommet 109 or completely sealed except for the grommet, wherein the grommet is the only opening available through which to dispense towels. In some embodiments, the device may alternatively utilize a gasket in place of the grommet 109.

In the present invention, the receptacle lid 103 has a shape and size complimentary to the superior opening 102 of the towel receptacle and is intended to seal the towels within the towel receptacle and prevent atmospheric particles or debris from entering the towel receptacle during normal use. In some embodiments, the receptacle lid 103 is fixed at the tip of the adjustable wall mounting mechanism. This enables the superior opening 102 of the towel receptacle to be exposed for a reloading process when the towel receptacle is repositioned further below via the adjustable wall mounting mechanism 106.

As shown in FIG. 1, the present invention comprises an adjustable wall mounting mechanism 106 that's utilized to mount the receptacle lid 103 and towel receptacle 101. The adjustable mounting mechanism 106 may be comprised of two parts, a fixed mount 107 and an adjustable mount 108. The fixed mount 106 is operable to fix the receptacle lid in place such that, during normal usage, the superior opening 102 is sealed by the receptacle lid such that ambient materials and debris may not enter the towel receptacle. The fixed mount 107 may be based on brackets, screws/nails, adhesives, or any mounting mechanism operable to firmly affix the receptacle lid 103 in place. The adjustable mount 108 is operable not only to mount the towel receptacle onto a flat surface, but to adjust the position of the towel receptacle on a vertical track. The adjustable mount 108 may be a roller/carriage (e.g., ball bearing carriages, sleeve bearing carriages, track roller carriages, roller bearing carriages, track rollers, etc.) with guide rails, linear motion shaft, positioning slides, or any mounting mechanism that may reposition the towel receptacle on the vertical track. For example, as shown in FIG. 1A, the adjustable mount may be a sliding traveler 108B operable to support a load (i.e., a towel receptacle), a track 108A operable to be mounted on a flat surface and provide a track (i.e., a vertical track) that may support the drawer profile and the corresponding load, and between ball bearings the track 108A and the traveler 108B operable to enable the traveler 108B to move freely and easily within the track 108A. The adjustable mount 108 may further comprise a motor operable to automatically reposition the towel receptacle at the press of a button. For example, the adjustable mount may be powered by an electric motor belt drive mechanism that is operable to reposition the dispenser 101 between a reloading orientation and dispensing orientation.

As shown in FIG. 8, the adjustable mount 108 may further comprise a locking mechanism 113, operable to lock the towel receptacle 101 in place at points on the vertical track. The points may be the uppermost and/or the lower most points on the vertical track, such that the towel receptacle 101 may be locked in either the dispensing orientation or reloading orientation. In some embodiments, the receptacle may be locked into position at any point along the vertical track. In some embodiments, the locking mechanism 113 may be inherent in the adjustable mount, wherein the locking occurs naturally due to limitations of the mount (i.e., the upper and lower boundaries of the drawer slides/rails). In some embodiments, the locking mechanism 113 may be an integrated component of the adjustable mount, wherein the locking may be controlled manually such as with a hand brake, switch, or by applying force to the adjustable mount in a particular manner (i.e., push-to-open). For example, an adjustable mount may comprise a ball bearing carriage and guide rails system with a hand brake, wherein the ball bearing carriage may support the towel receptacle and lock it in place via the hand brake anywhere on the guide rails. In other embodiments, the locking mechanism 113 may be a component separate from the adjustable mount, such as a simple tab operable to lock the towel receptacle and the adjustable mount and hold it at a specific point.

The shape of the present invention 100, along with its ability to be easily repositioned into a reloading orientation 111, vastly reduces the amount of effort and time an operator must expend in order to reload the towel receptacle 101. The shape of the towel receptacle 101 enables the dispenser to utilize gravitational force to advance the towels towards the inferior opening 104, enabling any cloth towel to be easily dispensed/grasped from the inferior opening 104 of the towel receptacle 101, regardless of the orientation of the towel. In other words, the shape of the towel receptacle 101 enables the dispenser to be easily loaded with towels 110 without the need to fold, roll, or arrange the towels in any particular manner.

It should be understood that the foregoing descriptions of specific embodiments of the present invention have been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and its practical application, and to thereby enable others skilled in the art to best utilize the invention and various embodiments with various modifications as are suited to the particular use contemplated.

What is claimed:

1. An improved towel dispenser for distributing textile towels comprised of:

a. a towel receptacle having
   i. a superior opening,
   ii. an inferior opening,
   iii. a tapering semi-conical shape that funnels towels towards said inferior opening, and
   iv. a flat side that enables said towel receptacle to be mounted on a flat surface;

b. a receptacle lid to seal said superior opening during normal use; and c. an adjustable wall mount operable to mount said towel receptacle lid and reposition said towel receptacle between a reloading orientation and a dispensing orientation, wherein said flat side is mechanically connected to said adjustable wall mount.

2. The towel dispenser of claim 1, wherein said towel receptacle has a height of in the range of about 18 inches to about 50 inches, said superior opening has a width in the range of about 16 inches to about 40 inches and a depth in the range of about 6 inches to 30 inches, and said inferior opening has a width in the range of about 4 inches to about 12 inches and a depth in the range of about 2 inches to about 6.

3. The towel dispenser of claim 2, wherein said inferior opening further comprises a rubber grommet operable to prevent towels from falling through said inferior opening, but allows said towels to be pulled through by hand.

4. The towel dispenser of claim 1, wherein said towel receptacle is in said reloading orientation when said towel receptacle is at the lowermost point on a vertical track of said adjustable wall mount.

5. The towel dispenser of claim 4, wherein said towel receptacle is in said dispensing orientation when at the said towel receptacle is at the uppermost point on said vertical track.

6. The towel dispenser of claim 5, wherein said adjustable mount further comprises a locking mechanism, operable to lock said towel receptacle at one or more points on said vertical track.

7. An improved towel dispenser for distributing washable, reusable textile towels comprised of:

a. a receptacle for said washable and reusable textile towels having i. a tapering semi-conical shape that tapers towards an inferior opening and allows loose towels to fall towards said inferior opening, ii. a flexible grommet at the inferior opening that prevents said towels from falling out of the inferior opening but allows a towel to be pulled by hand through the flexible grommet, and iii. a flat side that enables said towel receptacle to be mounted at or near a flat surface;

b. a receptacle lid to seal a superior opening during normal use; and c. an adjustable wall mount operable to mount said towel receptacle and reposition said towel receptacle between a reloading orientation and a dispensing orientation, wherein said flat side is mechanically connected to said adjustable wall mount.

8. The towel dispenser of claim 7, wherein said towel receptacle has a semi-conical shape.

9. The towel dispenser of claim 7, wherein said towel receptacle is in said reloading orientation when said towel receptacle is at the lowermost point on a vertical track of said adjustable wall mount and is in said dispensing orientation when at the said towel receptacle is at the uppermost point on said vertical track.

10. The towel dispenser of claim 7, wherein said adjustable wall mount includes a roller and carriage structure positioned between guide rails.

11. The towel dispenser of claim 7, wherein said adjustable wall mount further comprises a locking mechanism, operable to lock said towel receptacle at one or more points on said vertical track.

12. An improved towel dispenser for distributing washable and reusable textile towels comprised of:

a. a receptacle for said washable and reusable textile towels having i. a tapering body that tapers towards an inferior opening and allows loose towels to fall towards said inferior opening, wherein said towel receptacle has a semi-conical shape, and ii. a flexible grommet at the inferior opening that prevents said towels from falling out of the inferior opening but allows a towel to be pulled by hand through the flexible grommet; and b. an adjustable wall mount operable to mount said towel receptacle and reposition said towel receptacle between a reloading orientation and a dispensing orientation, wherein said body is mechanically connected to said adjustable wall mount.

13. The towel dispenser of claim 12, further comprising a receptacle lid to seal a superior opening during normal use.

14. The towel dispenser of claim 12, further comprising a flat side that enables said towel receptacle to be mounted at or near a flat surface.

15. The towel dispenser of claim 12, wherein said towel receptacle is in said reloading orientation when said towel receptacle is at the lowermost point on a vertical track of said adjustable wall mount and is in said dispensing orientation when at the said towel receptacle is at the uppermost point on said vertical track.

16. The towel dispenser of claim 12, wherein said washable, reusable towels are Terrycloth towels.

* * * * *